US009518400B2

(12) United States Patent
Acklin

(10) Patent No.: US 9,518,400 B2
(45) Date of Patent: Dec. 13, 2016

(54) SWIMMING POOL COVER PUMP WITH INTEGRAL WATER EJECTION SPOUT

(71) Applicant: Joseph T. Acklin, Carmel, IN (US)

(72) Inventor: Joseph T. Acklin, Carmel, IN (US)

( * ) Notice: Subject to any disclaimer, the term of this patent is extended or adjusted under 35 U.S.C. 154(b) by 257 days.

(21) Appl. No.: 14/176,294

(22) Filed: Feb. 10, 2014

(65) Prior Publication Data

US 2015/0050162 A1 Feb. 19, 2015

Related U.S. Application Data

(63) Continuation-in-part of application No. 13/967,033, filed on Aug. 14, 2013.

(51) Int. Cl.
*E04H 4/00* (2006.01)
*E04H 4/16* (2006.01)
*E04H 4/10* (2006.01)

(52) U.S. Cl.
CPC .. *E04H 4/16* (2013.01); *E04H 4/10* (2013.01)

(58) Field of Classification Search
USPC ..... 4/498
See application file for complete search history.

(56) References Cited

U.S. PATENT DOCUMENTS 2,772,421 A * 12/1956 Friend ..... A61H 33/6026 4/541.3
3,579,657 A * 5/1971 Gurrieri ..... E04H 4/10 210/474
D328,748 S * 8/1992 Eng ..... 137/135
5,624,238 A * 4/1997 Herbert ..... A62C 25/00 417/234
2008/0166244 A1* 7/2008 Winge ..... F04D 13/02 417/234

* cited by examiner

*Primary Examiner* — Huyen Le
(74) *Attorney, Agent, or Firm* — Bruce J. Bowman

(57) ABSTRACT

A device and method is provided for removing water that has accumulated on a swimming pool cover in the form of a directed stream or spray from a swimming pool cover pump having an integral water ejection spout. The water ejection spout has tubing extending from the pump housing, and a nozzle coupled to the tubing for expelling the pumped water. The water ejection spout is configured to discharge the pumped water in a directed stream or spray upwardly, outwardly and away from the swimming pool cover pump and thus the swimming pool cover. In one form, the swimming pool cover pump with integral water ejection spout includes another water outlet configured to receive a garden hose. Piping and a valve allows user selection of the desired water outlet—namely, either the water ejection spout or the garden hose water outlet.

16 Claims, 16 Drawing Sheets

SWIMMING POOL COVER PUMP WITH INTEGRAL WATER EJECTION SPOUT

CROSS-REFERENCE TO RELATED APPLICATIONS

This U.S. non-provisional patent application is a continuation-in-part of co-pending U.S. non-provisional patent application Ser. No. 13/967,033 filed Aug. 14, 2013 titled "Method and Device for Removing Water From a Swimming Pool Cover", the entire contents of which is specifically incorporated herein by reference.

FIELD OF THE INVENTION

The present invention relates to methods and devices for removing water from a swimming pool cover and, more particularly, to methods and devices for removing water from a swimming pool cover using a swimming pool cover pump.

BACKGROUND

Many swimming pools have covers for keeping dirt, debris and other undesirable elements from getting into the pool. Covers also keep children from falling into the pool when the pool is unattended, and unauthorized people from entering the pool. Covers are thus made to withstand substantial weight so that if someone were to fall or walk onto the cover it would hold their weight.

However, because of the various purposes of a swimming pool cover, they are made such that they are impermeable to water. Therefore, water, generally because of rain, accumulates on the swimming pool cover. In order to use the swimming pool, any water on the cover must first be removed before the cover can be manually taken off or automatically rolled back. The prior art manner of removing water from a pool cover is to use a pool cover pump.

FIG. 1 shows a typical swimming pool 10 with a cover 12. While the cover 12 is shown as an automatic type pool cover, it should be appreciated that the same prior art method applies to manual type pool covers. An accumulation of water 14 is shown on the cover 12. A typical pool cover pump 16 has been placed in the accumulation of water 14. The pool cover pump 16 operates via electricity and thus includes a power cord 17 that is connected to a source of electricity (not shown). The pump 16 has a connector 19 through which the water is pumped. The pump connector 19 is configured (i.e. threaded) such that a typical hose 18 can be connected to the pump 16. This setup guides the accumulated water 14 from the cover 12 and out the hose 18.

While the prior art manner of removing water from a swimming pool cover certainly works, there are many associated hassles, particularly with the hose and the water being removed. First, a hose of sufficient length to channel the water to a desired outflow area must be connected to the pool cover pump, and secondly, the hose 18 must be connected to the pool cover pump, stretched out and appropriately placed such that the pumped water flows into the desired outflow area. This procedure must be accomplished every time accumulated water is removed from the pool cover.

Moreover, the water being removed flows from the hose 18 in a large continuous stream. As such, the continuous stream of water from the hose is not well suited for anything other than wasting the water. If the hose is placed such that the continuous stream of water outflows into a yard, the outflow area will quickly become saturated.

In view of the above, what is therefore needed is a better manner of removing accumulated water from a swimming pool cover.

SUMMARY OF THE INVENTION

The present invention is a device and method of removing accumulated water from a swimming pool cover that ejects, expels and/or disperses outflowing water from a swimming pool cover pump in the form of a directed stream or spray.

Particularly, the present invention is a swimming pool cover pump having an integral water ejection spout that is configured to spray the water away from the swimming pool cover in the form of a directed stream or spray.

The water ejection spout is characterized by a conduit extending from the swimming pool cover pump housing along with a nozzle at the end of the conduit. The spout is shaped such that the nozzle directs the outgoing stream or spray of water out and away from the swimming pool cover pump and thus the swimming pool cover. The nozzle may have an internal configuration that increases the velocity of the outgoing stream of water in order to further project the outgoing stream of water from the swimming pool cover pump and thus the swimming pool cover. The nozzle may further have a configuration that allows adjustment of the velocity of the outgoing stream of water.

In one form, the spout has a conduit of a fixed shape that provides a fixed direction and inclination of the outgoing stream of water. In another form, the spout has a telescoping conduit structure that provides telescoping adjustment to the direction and inclination of the outgoing stream of water. In yet another form, the spout has a bendable conduit that provides infinite adjustment to the direction and inclination of the outgoing stream of water. Other conduit configurations for adjustment of the direction and/or inclination of the outgoing stream of water are contemplated.

The present swimming pool cover pump with the integral water ejection spout may additionally include a separate water outlet configured to receive a traditional garden hose. In this form, the swimming pool cover pump has appropriate internal piping and a valve or switch that allows the user to selectively connect either the spout or the hose outlet to the internal pumping mechanism of the pump for water ejection.

A method of removing accumulated water from a swimming pool cover includes providing a swimming pool cover pump having an integral water ejection spout as described herein, positioning the swimming pool cover pump such that the nozzle of the integral water ejection spout directs its outgoing water stream away from the swimming pool cover pump and activating the swimming pool cover pump.

The incorporation of a water ejection spout into a swimming pool cover pump provides various advantages over current swimming pool cover pumps. One advantage is a quicker, cleaner and more convenient setup and removal of the swimming pool cover pump due to the lack of a garden hose or the desire to not connect a garden hose. Another advantage is that the spout and/or spout nozzle does not freeze in cold weather when the pump turns off, since the water, by gravity, falls back into and out of the pump. The present swimming pool cover pump with integral water ejection spout also replaces the garden hose.

DETAILED DESCRIPTION

Figure 1:
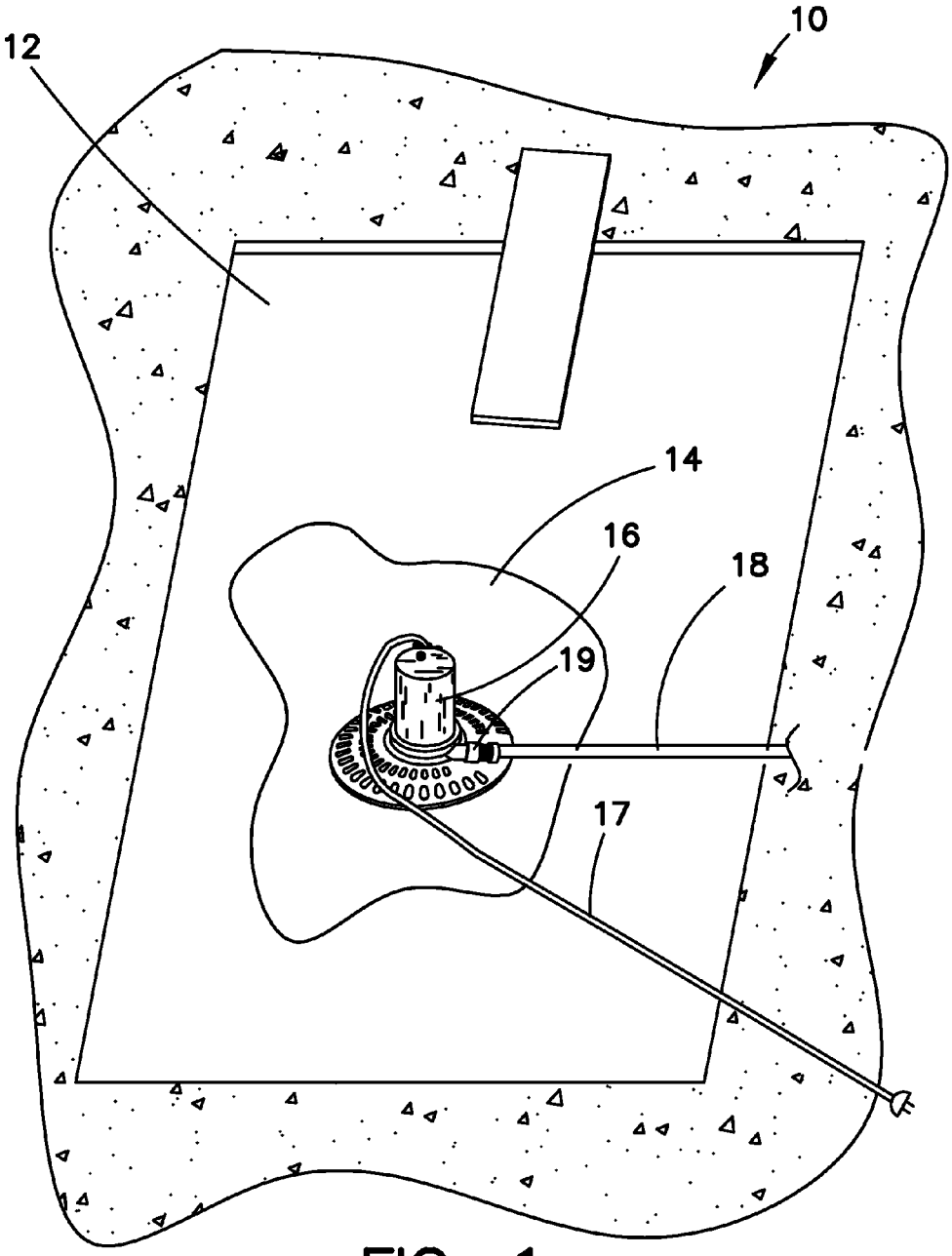
FIG. 1 (PRIOR ART)
FIG. 1 is an illustration of a prior art manner of removing water from a pool cover using a pool cover pump.
Figure 2:
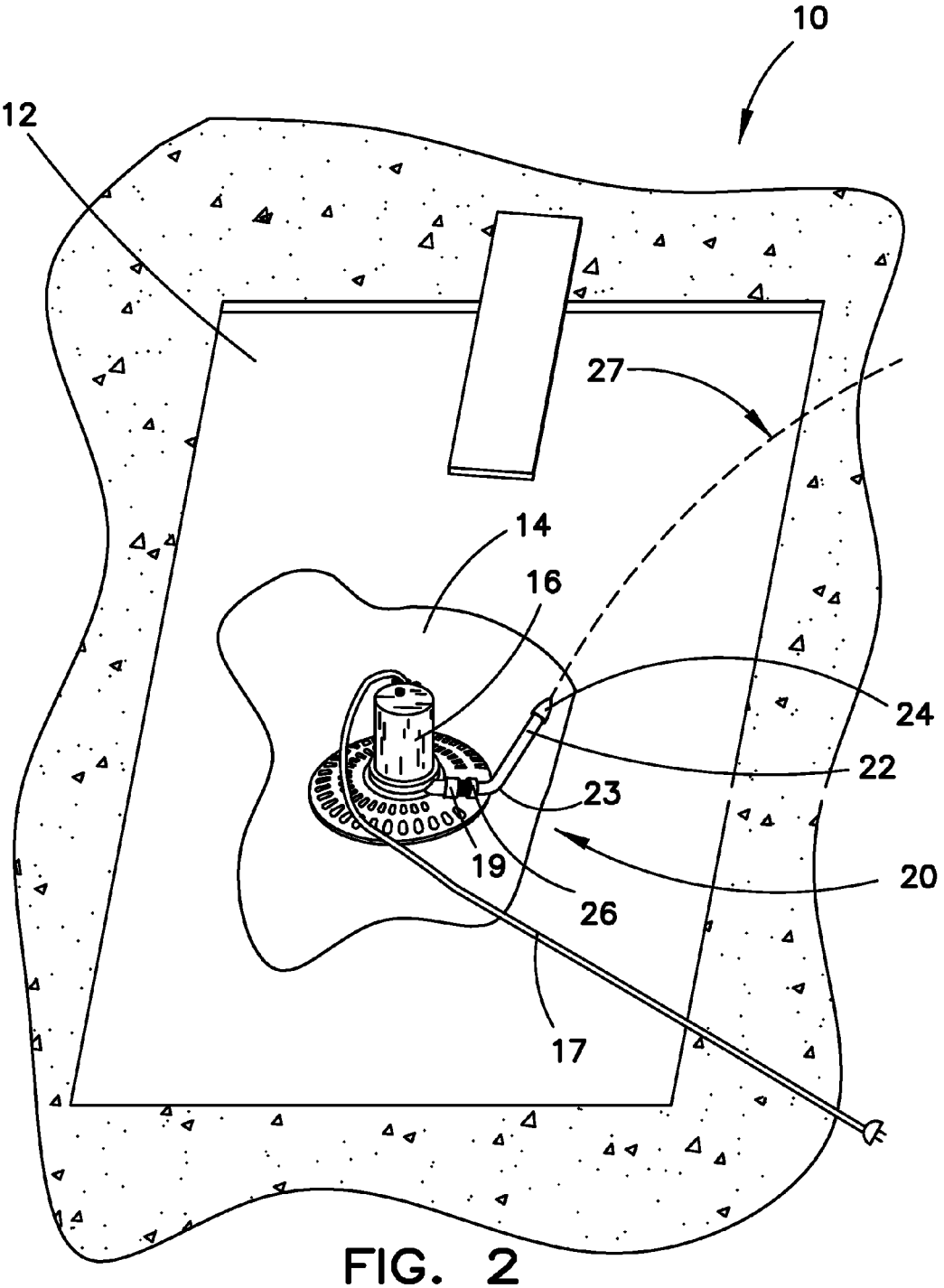
FIG. 2 is an illustration of a manner of removing water from a pool cover using a pool cover pump in accordance with the principles of the present invention, the present manner of removing water from a pool cover using a water ejection spout.

Referring to FIG. 2, there is shown the typical swimming pool 10 with a cover 12 as depicted in FIG. 1. While the cover 12 is shown as an automatic type pool cover, it should be appreciated that the present method and associated device applies to manual type pool covers. An accumulation of water 14 is shown on the cover 12. A typical swimming pool cover pump 16 has been placed in the accumulation of water 14. The swimming pool cover pump 16 operates via electricity and thus includes a power cord 17 that is connected to a source of electricity (not shown). The swimming pool cover pump 16 includes a connector 19 through which the accumulated water is pumped.

In accordance with the principles of the present invention, an exemplary embodiment of a water ejection spout 20 is connected to the swimming pool cover pump 16. The water ejection spout 20 is configured to discharge, spray, expel and/or otherwise disperse the accumulated water 14 in a stream 27. The water ejection spout 20 includes a length of tube/tubing, conduit, pipe/piping, or the like (collectively, tube) 22 that is preferably, but not necessarily, made from a plastic such as PVC. Other types of plastic and materials may be used if desired. Moreover, the tube 22 may be semi-rigid or bendable if desired. The length of tube 22 projects upwardly and outwardly from an angled portion 23 which in turn, is coupled to a connector 26. The connector 26 is threaded for attachment to the pump connector 19. A nozzle 24 is situated at an end of the tube 22. The nozzle 24 is configured to discharge, eject, expel, spray and/or otherwise disperse the outflowing stream of water 27 (collectively, stream) a distance up and away from the pool 10 and the pool cover 12. As such, the stream of water 27 is well suited for watering the lawn, directing the water to a desired outflow area, or otherwise controllably discharging the pumped water.

Because the water ejection spout 20 is rigid (or at least semi-rigid) the swimming pool cover pump 16 and thus the water ejection spout 20 is easily positionable on the pool cover 12 such that the direction of the water stream 27 is easily controlled. Thus, instead of moving a cumbersome hose, only the swimming pool cover pump 16 needs to be turned or otherwise positioned in order to direct the water stream 27 as desired.

Figure 3:
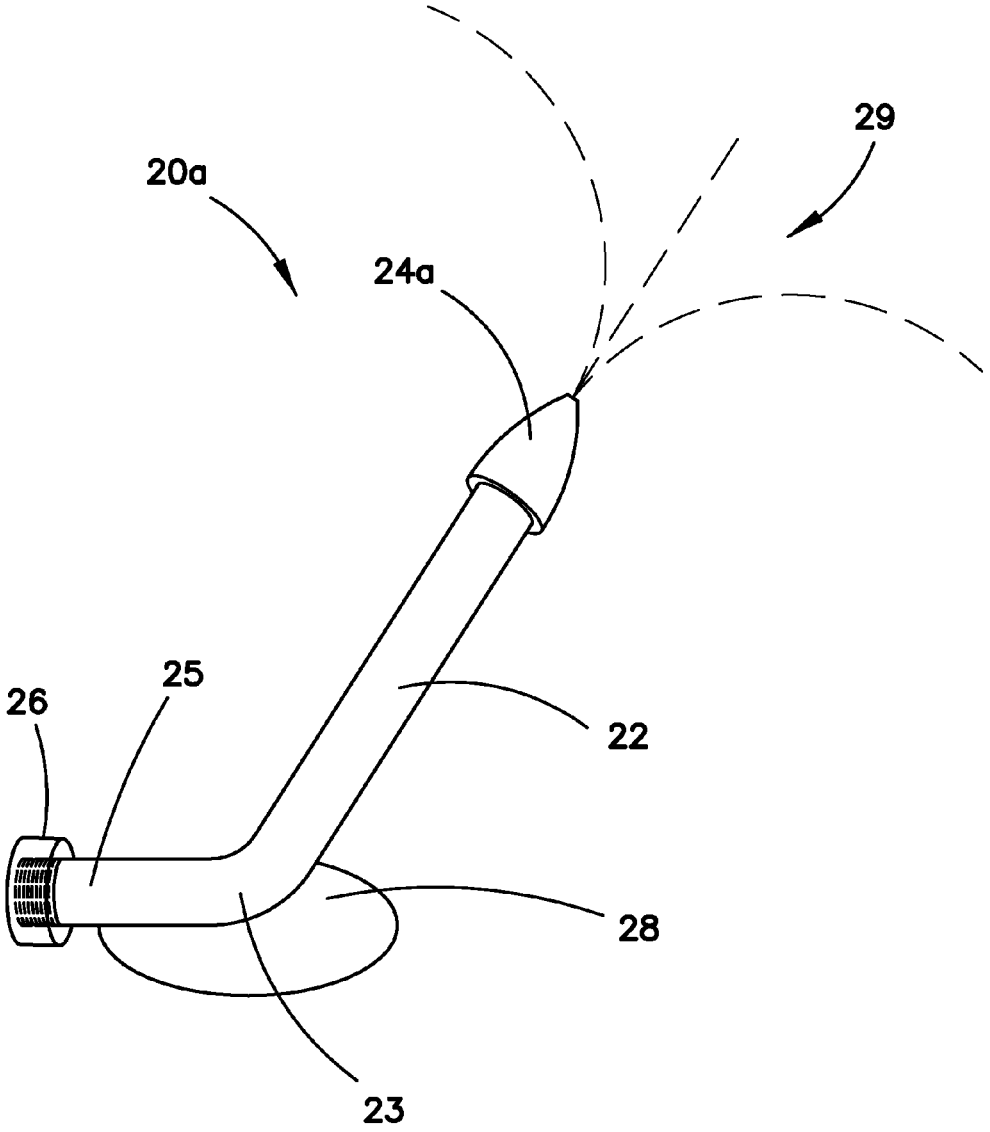
FIG. 3 is another embodiment of a water ejection spout fashioned in accordance with the present principles.

Referring now to FIG. 3, there is depicted another embodiment of a water ejection spout 20*a* fashioned in accordance with the present principles that is connectable to the swimming pool cover pump 16 (not shown in FIG. 3). The water ejection spout 20*a* is configured to expel and/or disperse the accumulated water 14 in a spray 29. The water ejection spout 20*a* includes the length of tube 22 like the water ejection spout 20. The length of tube 22 projects upwardly and outwardly from the angled portion 23 which in turn, is coupled to the connector 26 via an extended length of tube 25. The connector 26 is threaded for attachment to the pump connector 19. A nozzle 24*a* is again situated at an end of the tube 22. The nozzle 24*a* is configured to discharge, spray, eject, expel and/or otherwise disperse the outflowing spray of water 29 a distance up and away from the pool 10 and the pool cover 12. As such, the spray or stream of water 29 is well suited for watering the lawn, directing the water to a desired outflow area, or otherwise controllably discharging the pumped water.

The water ejection spout 20*a* includes a base 28 on which the extended length of tube 25 and the angled portion 23 rests. The base 28 provides extra stability to the water ejection spout 20 to inhibit and/or prevent it from tipping over. Because the water ejection spout 20*a* is rigid (or at least semi-rigid) the swimming pool cover pump 16 and thus the water ejection spout 20*a* is easily positionable on the pool cover 12 such that the direction of the water spray 29 is easily controlled. Thus, instead of moving a cumbersome hose, only the swimming pool cover pump 16 needs to be turned or otherwise positioned in order to direct the water spray 29 as desired.

Figure 4:
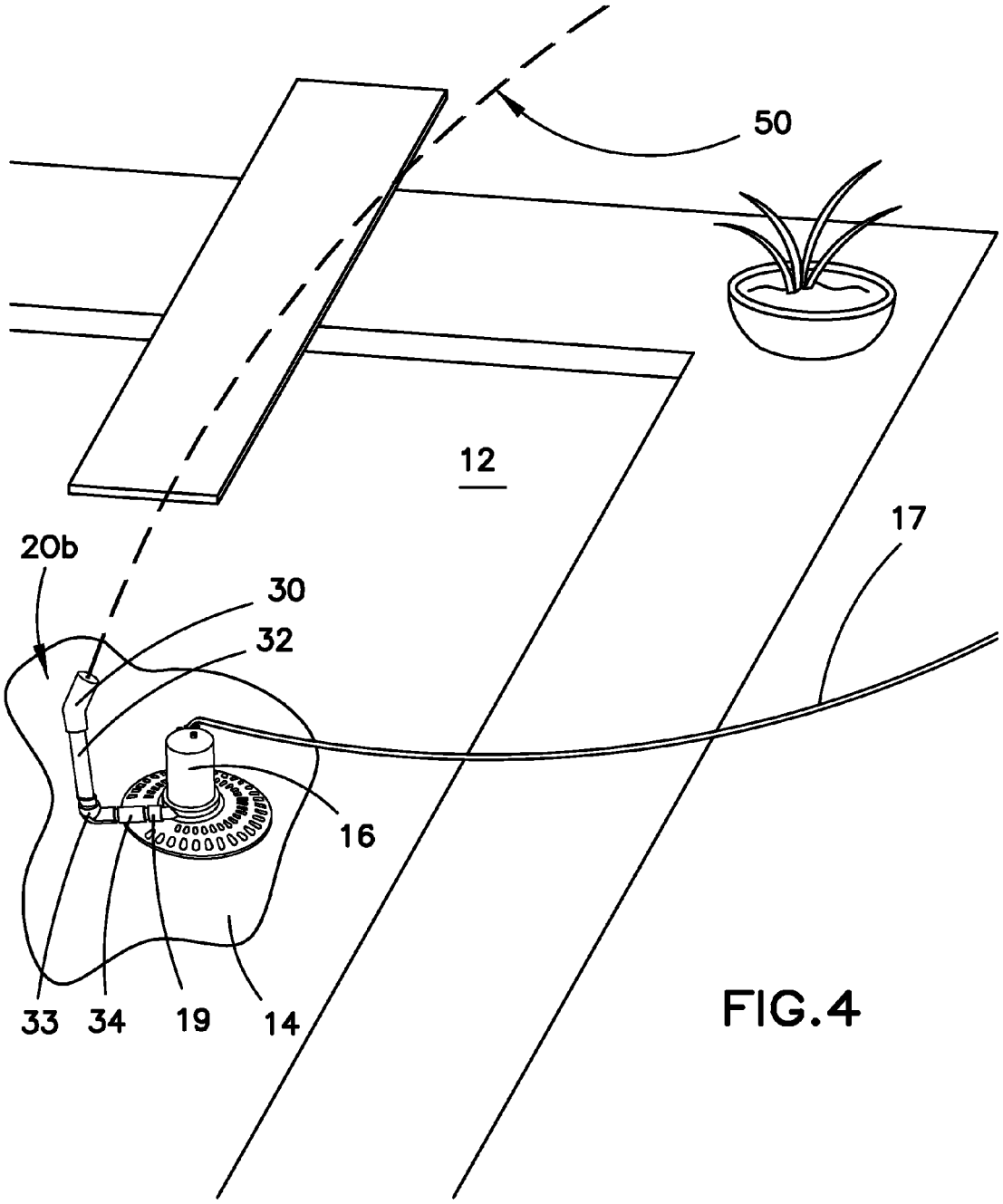
FIG. 4 is an illustration of the present manner of removing water from a pool cover using a pool cover pump with another embodiment of a water ejection spout.
Figure 5:
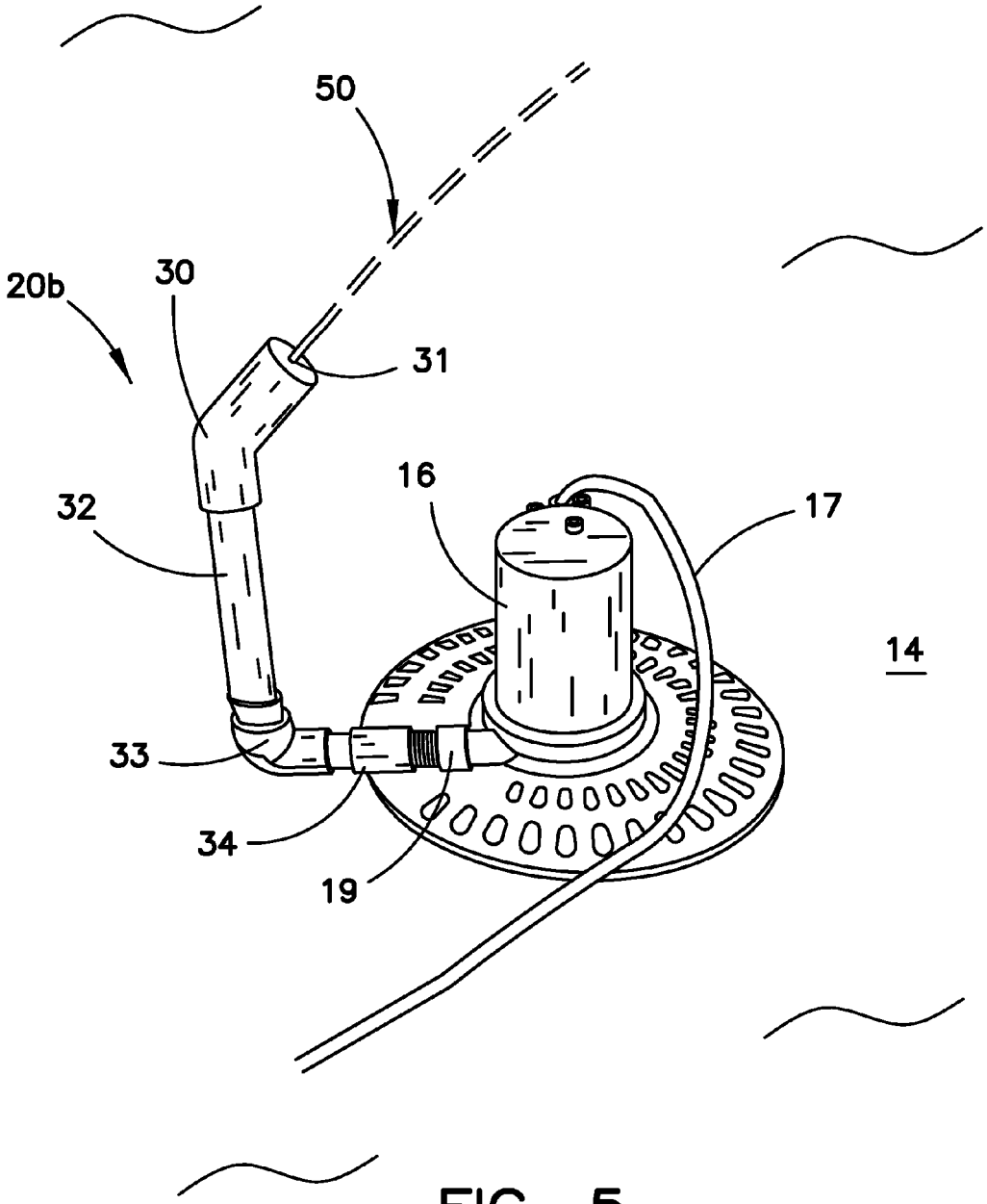
FIG. 5 is an enlarged view of the water ejection spout connected to the pool cover pump as shown in FIG. 4.

Referring now to FIGS. 4 and 5, there is shown another exemplary embodiment of a water ejection spout 20*b* fashioned in accordance with the present principles that is connectable to the swimming pool cover pump 16. The water ejection spout 20*b* is configured to discharge, spray, stream, expel and/or otherwise disperse the accumulated water 14 in a stream 50. In this embodiment, rather than expelling the water upwardly, outwardly and away from the pump as per the water ejection spouts 20 and 20*a*, the water is expelled upwardly, away and over the swimming pool cover pump 16. This helps to inhibit or prevent the force of the expelled water from rotating or otherwise affecting the position of the swimming pool cover pump 16.

The water ejection spout 20*b* includes connector 34 that is configured for threaded connection with the pump connector 19. An elbow 33, providing a right angle joint, is attached to the end of the connector 34. A length of tube 32 projects upwardly from the elbow 33. A nozzle 30 having a nozzle opening 31 is situated at an end of the tube 32. The nozzle 30 is angled such that the ejected outflowing stream of water 50 flows upwardly, outwardly and over the swimming pool cover pump 16 a distance away from the pool 10 and the pool cover 12. As such, the stream of water 50 is again well suited for watering the lawn, directing the water to a desired outflow area, or otherwise controllably discharging the pumped water. The direction of the ejected stream of water 50 counteracts any force exerted on the spout 20*b* and the swimming pool cover pump 16 such that the swimming pool cover pump 16 will not rotate or be moved thereby.

Figure 6:
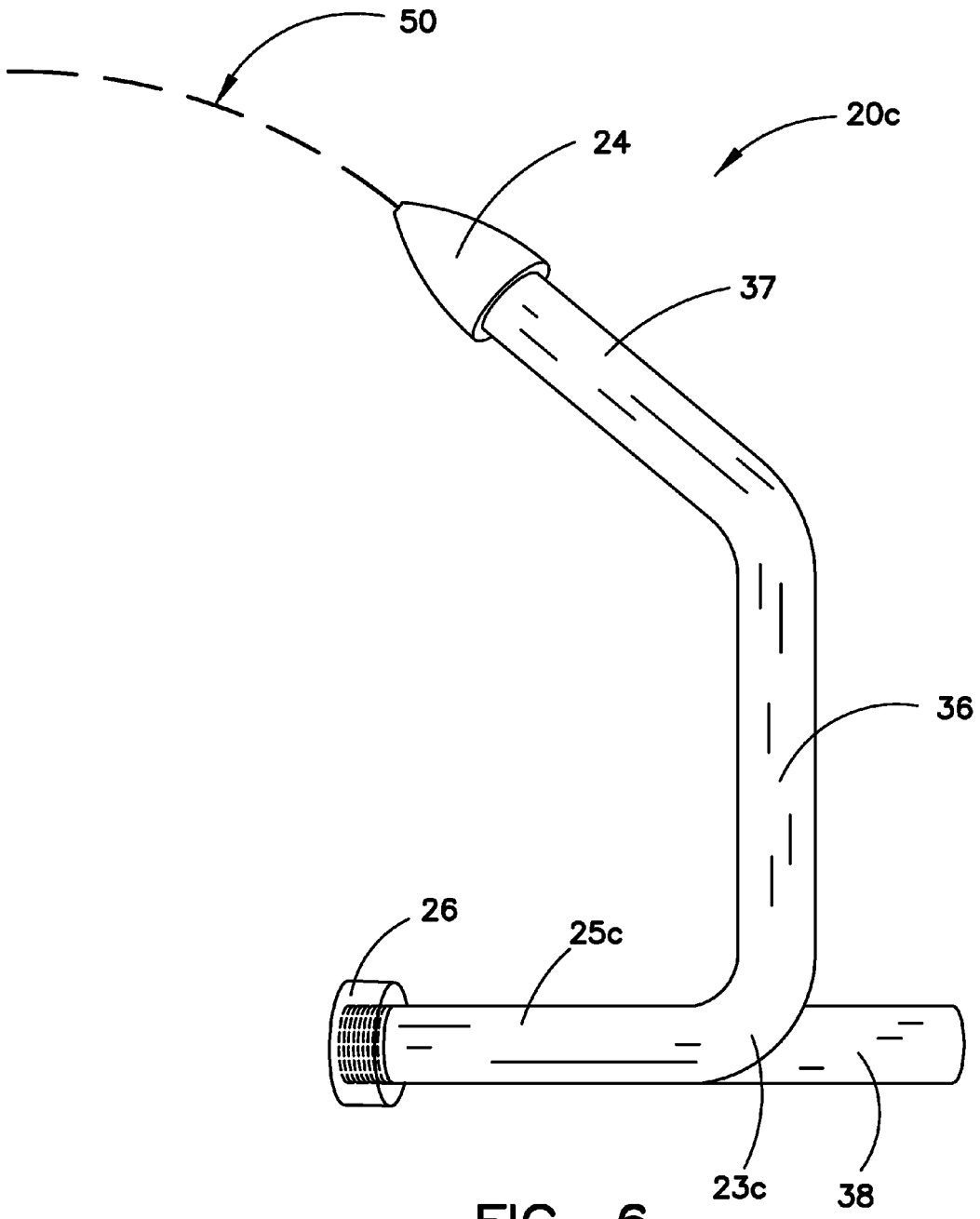
FIG. 6 is an enlarged view of another embodiment of a water ejection spout fashioned in accordance with the present principles.

Referring now to FIG. 6, there is depicted yet another exemplary embodiment of a water ejection spout 20*c* fashioned in accordance with the present principles that is connectable to the swimming pool cover pump 16 (not shown in FIG. 6). The water ejection spout 20*c*, like the water ejection spout 20*b*, ejects, discharged, sprays, streams, expels and/or otherwise disperses the water upwardly, away and over the swimming pool cover pump 16. The water ejection spout 20*c* has a threaded connector 26 for connection to the pump connector, a straight length of tube 25*c* coupled to the connector 26, an angled portion 23*c* that provides a generally 90° bend, a second straight length of tube 36 extending upwardly from the angled portion 23*c*, and a third straight length of tube 37 that extends from the second length of tube 36 at an angle such that the nozzle 24 ejects a stream of water 50 upwardly, away from and over the pump (not shown in FIG. 6). The water ejection spout 20*c* further includes an extension 38 that projects from the straight length of tube 25*c* to provide stability to the water ejection spout 20*c*.

Figure 7:
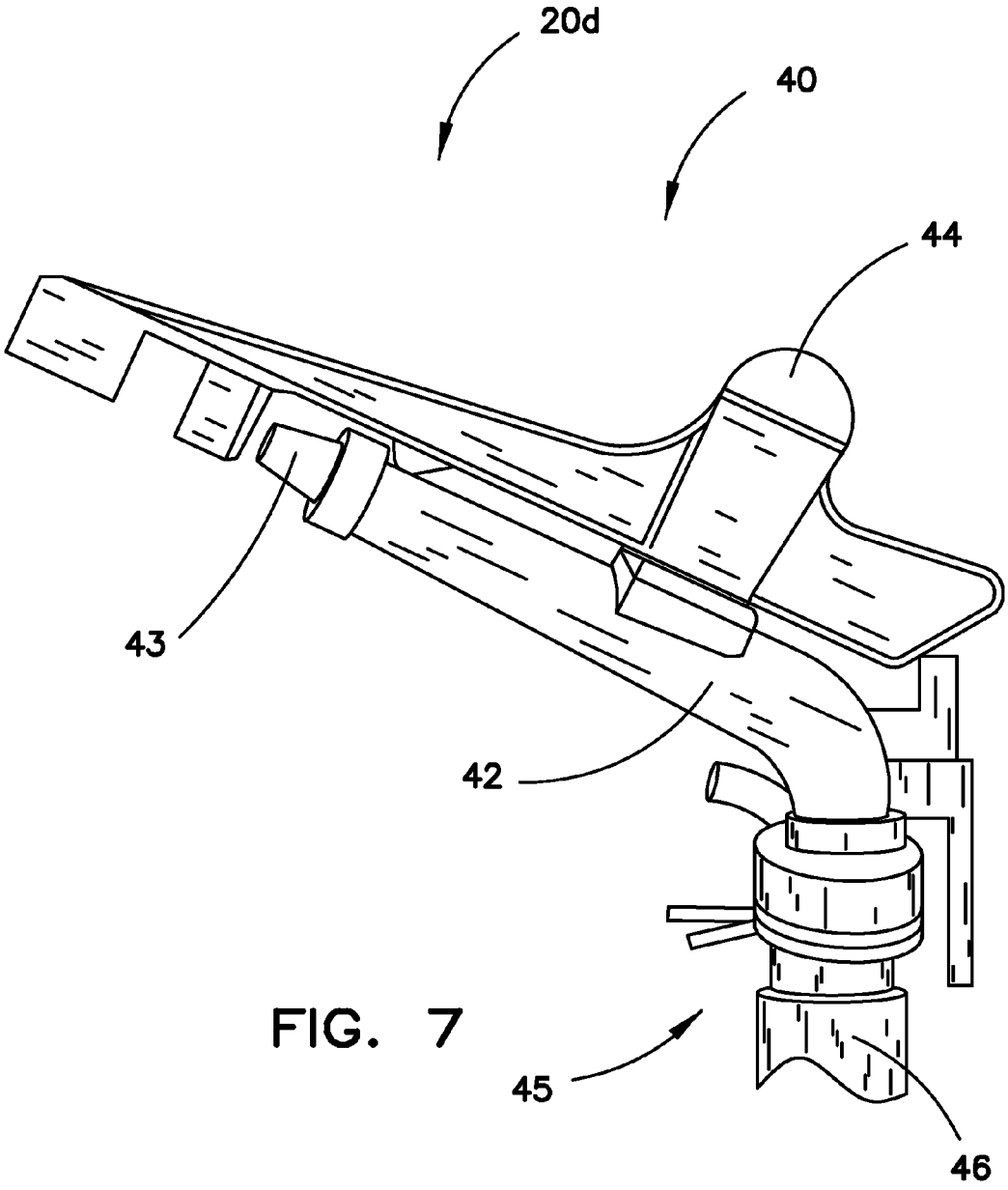
FIG. 7 is a view of a rotating nozzle for the present water ejection spouts according to the present principles.

Referring now to FIG. 7, there is shown an alternate nozzle 40 for yet another exemplary embodiment of a water ejection spout 20*d*. While the nozzle 40 is described with respect to the water ejection spout embodiment 20*d*, it should be appreciated that the nozzle 40 may be used on any of the water ejection spouts described herein. The nozzle 40 is also representative of nozzles that provide a moving or adjustable spray or stream of water from the water ejection spout.

The nozzle 40 is illustrated as a typical rotating (moving) spray head. The nozzle 40 is situated on an end of a tube section 46 of the water ejection spout 20*d*. A curved tube section 42 extends from the tube section 46 and terminates in a water ejection head 43. A spring/rotation mechanism 45 is provided that is coupled to an actuating arm 44. Pressure from the ejected water causes the nozzle 40 to rotate as desired.

Figure 8:
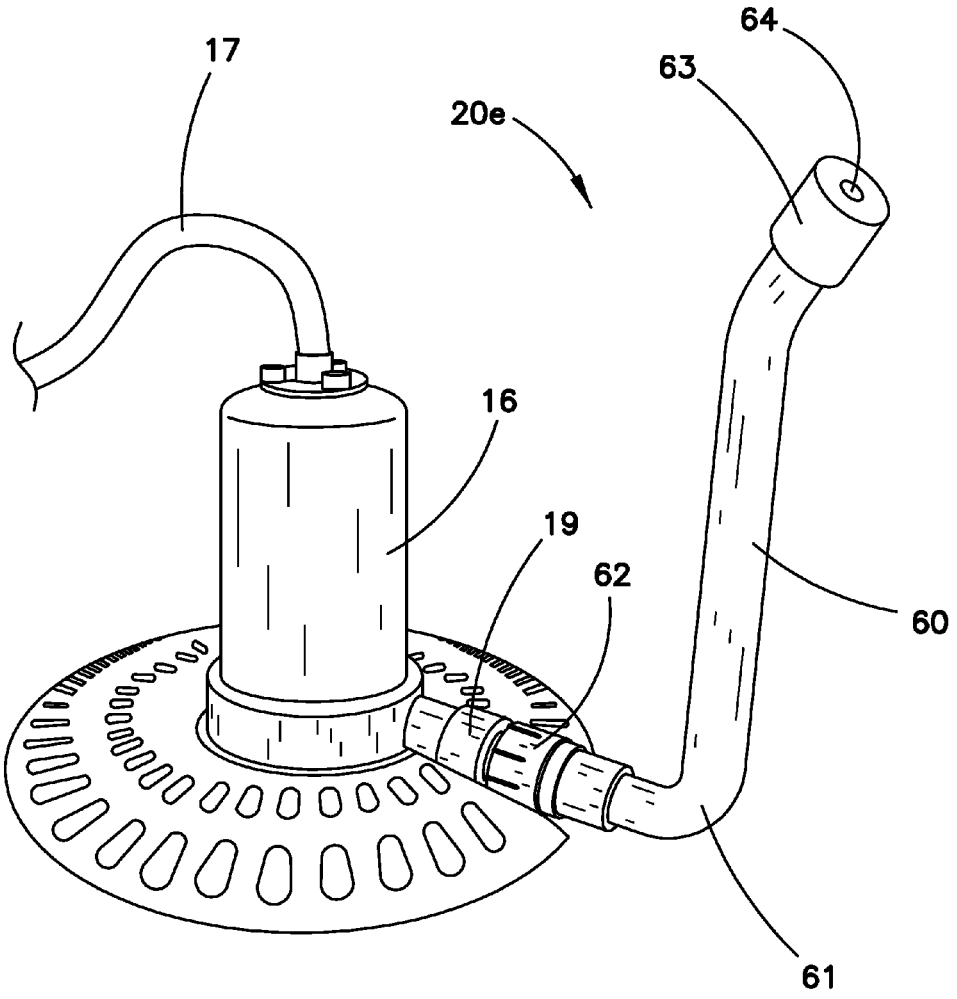
FIG. 8 is a view of another water ejection spout fashioned in accordance with the present principles connected to a pool cover pump.

Referring now to FIG. 8, there is depicted a further embodiment of a water ejection spout 20*e* fashioned in accordance with the present principles that is connected to the swimming pool cover pump 16. The water ejection spout 20*e* is configured to discharge, spray, stream, expel and/or otherwise disperse the accumulated water 14 in a stream (not shown). The water ejection spout 20*e* includes a threaded connector section 62 that is configured for attachment to the threaded pump connector 19. An angled section 61 extends upwardly and slightly outwardly from the connector section. A length of generally linear (straight) tube 60 extends from the angled section 61 and includes an outward bend at its distal end. A nozzle 63 have an orifice 64 is situated at the end of the bend. The nozzle 63 is configured to eject, expel and/or disperse the outflowing stream of water (not shown) a distance away from the pool 10 and the pool cover 12.

Figure 9:
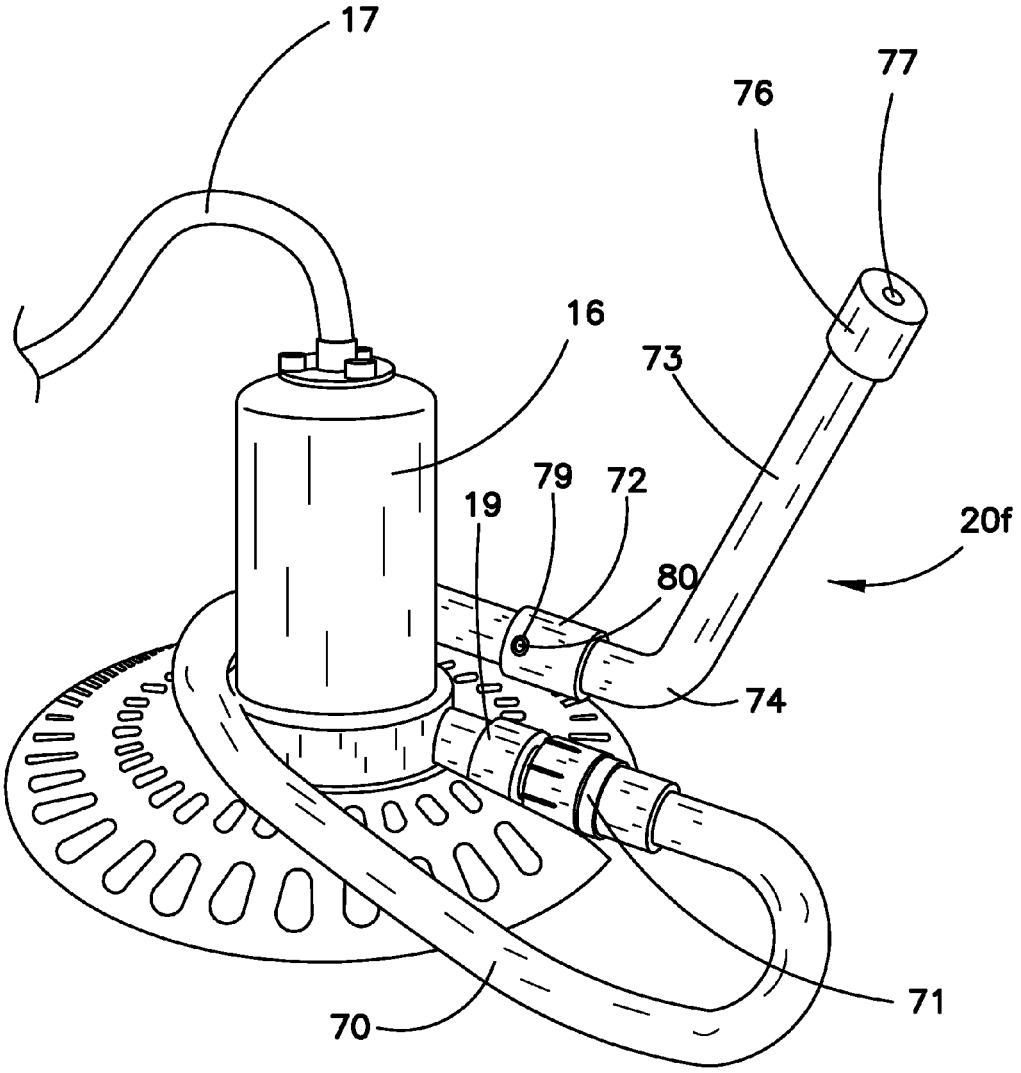
FIG. 9 is a view of another water ejection spout fashioned in accordance with the present principles connected to a pool cover pump.
Figure 10:
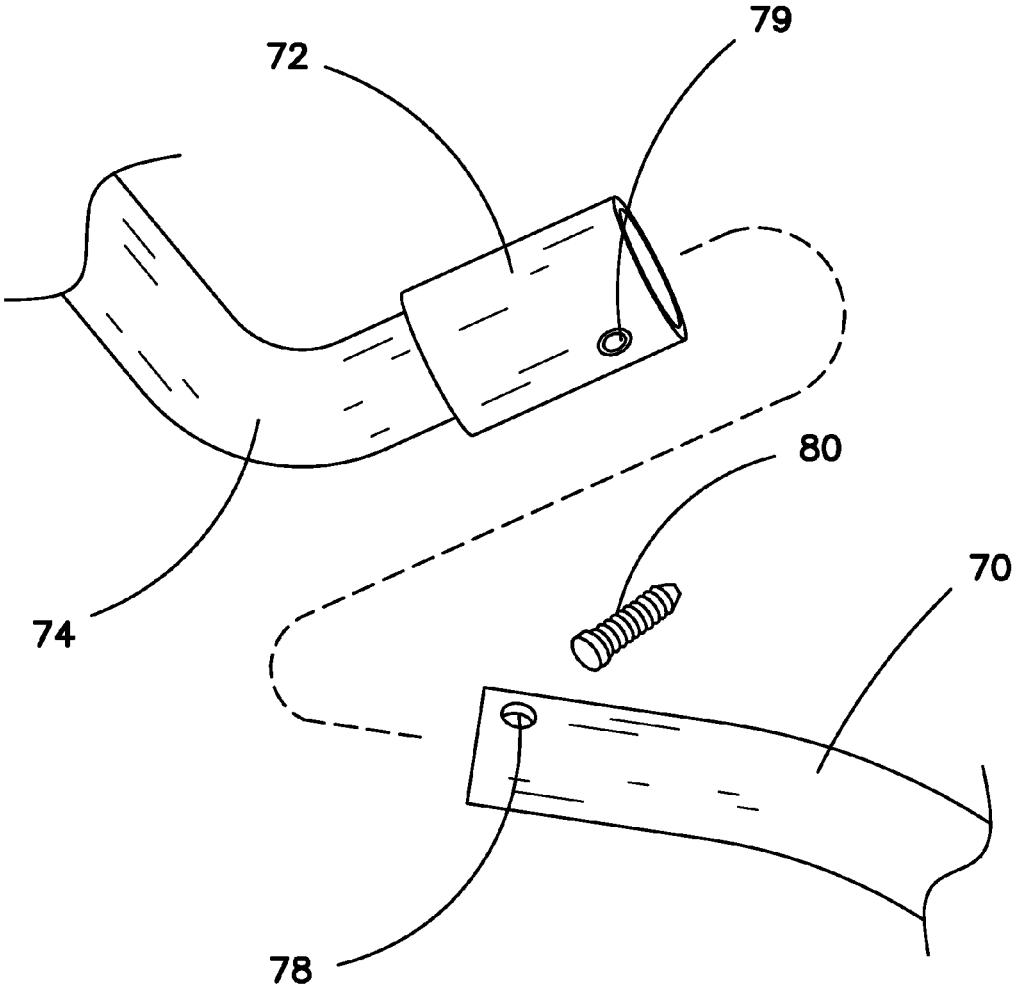
FIG. 10 is an enlarged view of connecting portions of the water ejection spout of FIG. 9.

Referring to FIGS. 9 and 10, there is depicted a still further embodiment of a water ejection spout 20*f* fashioned in accordance with the present principles. The water ejection spout 20*f* is configured to address any possible rotation and/or tipping of the pool pump and connected water ejection spout that can be caused by the pressure of the outflowing water stream or spray. The water ejection spout 20*f* thus provides a water ejection spout that is anti-rotation and anti-tipping to the pump/spout configuration.

The water ejection spout 20*f* includes a threaded connector 71 that is configured to couple to the threaded pump connector 19. A first tube 70 extends from the connector 71 and is shaped to wrap around the pump 16. The first tube 70 has a bore 78 at its distal end. A second tube 73 having a bend 74 and a tube connector 72 at one end is adapted to allow connection of the first tube 70. The tube connector 72 has a bore 79 that aligns with the bore 78 of the first tube 70. A pin 80 or similar device is received in the bores 79 and 80 in order to secure the two tubes 70, 74 together. The tubes/tube sections 70 and 73 are separate to aid in packaging and/or storage of the water ejection spout 20*f*.

Figure 11:
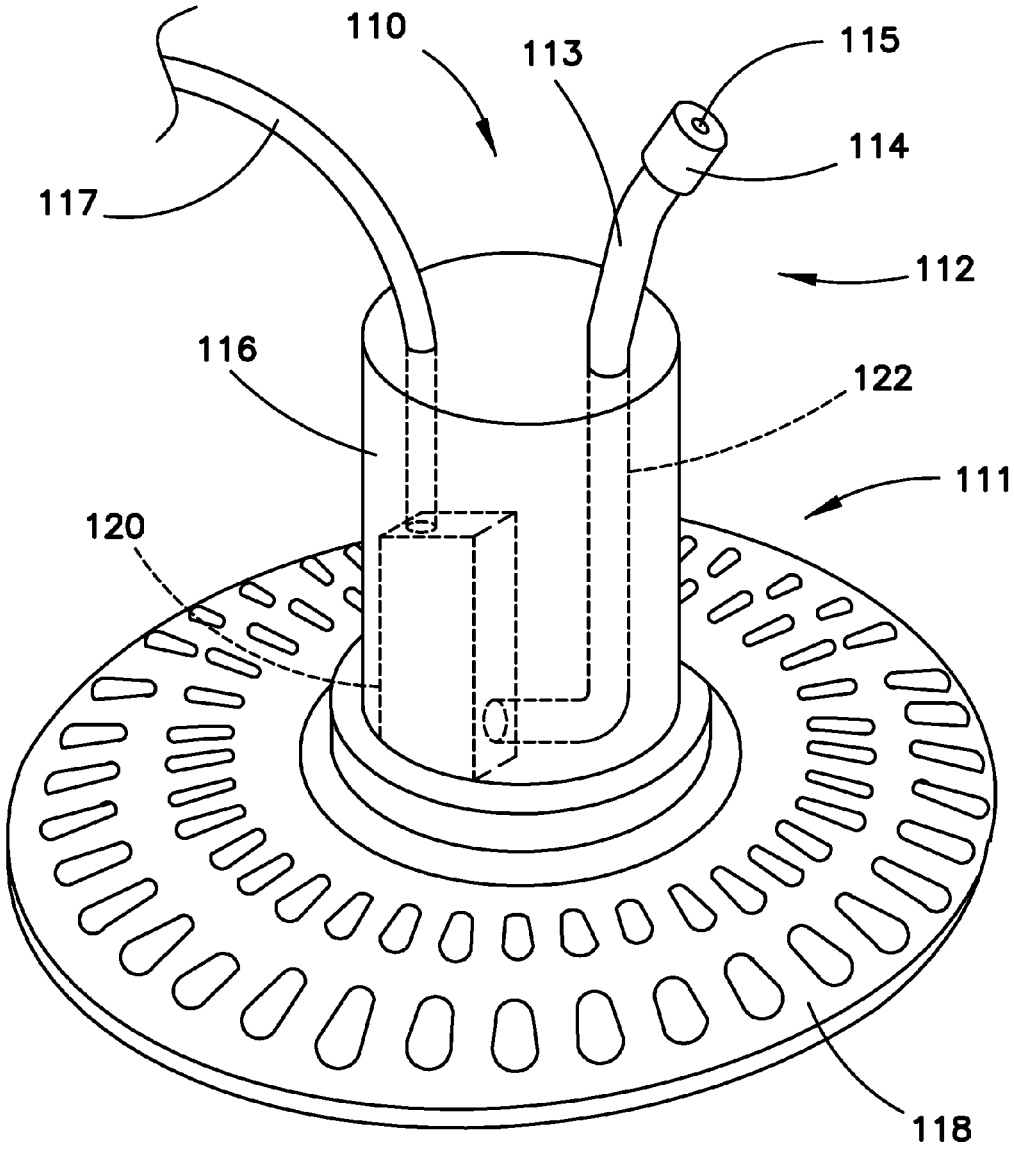
FIG. 11 is a view of a swimming pool cover pump having an integral water ejection spout in accordance with the present principles.

Referring to FIG. 11, there is shown a swimming pool cover pump having an integral or "built-in" water ejection spout, generally designated 110, fashioned in accordance with the present principles. Particularly, the swimming pool cover pump with integral water ejection spout 110 includes a swimming pool cover pump 111 with an integral water ejection spout 112.

The swimming pool cover pump 111 may be fashioned as a typical swimming pool cover pump having a housing 116 that encloses an electrically driven pump 120 having an inlet at the bottom of the housing 116. An electrical cord 117 supplies electricity to the electrical pump 120. A base 118 defining a debris screen is provided about the base of the pump housing 116.

Internal piping 122 extends between an outlet of the electrical pump 120 and the water ejection spout 112 which is situated at the top of the housing 116. Of course, the water ejection spout 112 may extend from a side of the housing 116 or other portion as desired. The water ejection spout 112 is characterized by a length of conduit or piping 113 having a nozzle 114 on its end. The internal piping 122 is in communication with the conduit 113 of the water ejection spout 112, with the conduit 113 in communication with the nozzle 114. The nozzle 114 has an orifice 115 that is configured to discharge water being pumped by the electrical pump 120 in the form of a spray, stream, jet or the like. The conduit 113 is preferably, but not necessarily, fixedly bent, curved or angled (configured) such that the nozzle 114 discharges the outgoing water, up, outwardly and/or away from the swimming pool cover (see, e.g., FIGS. 2 and 4).

Figure 12:
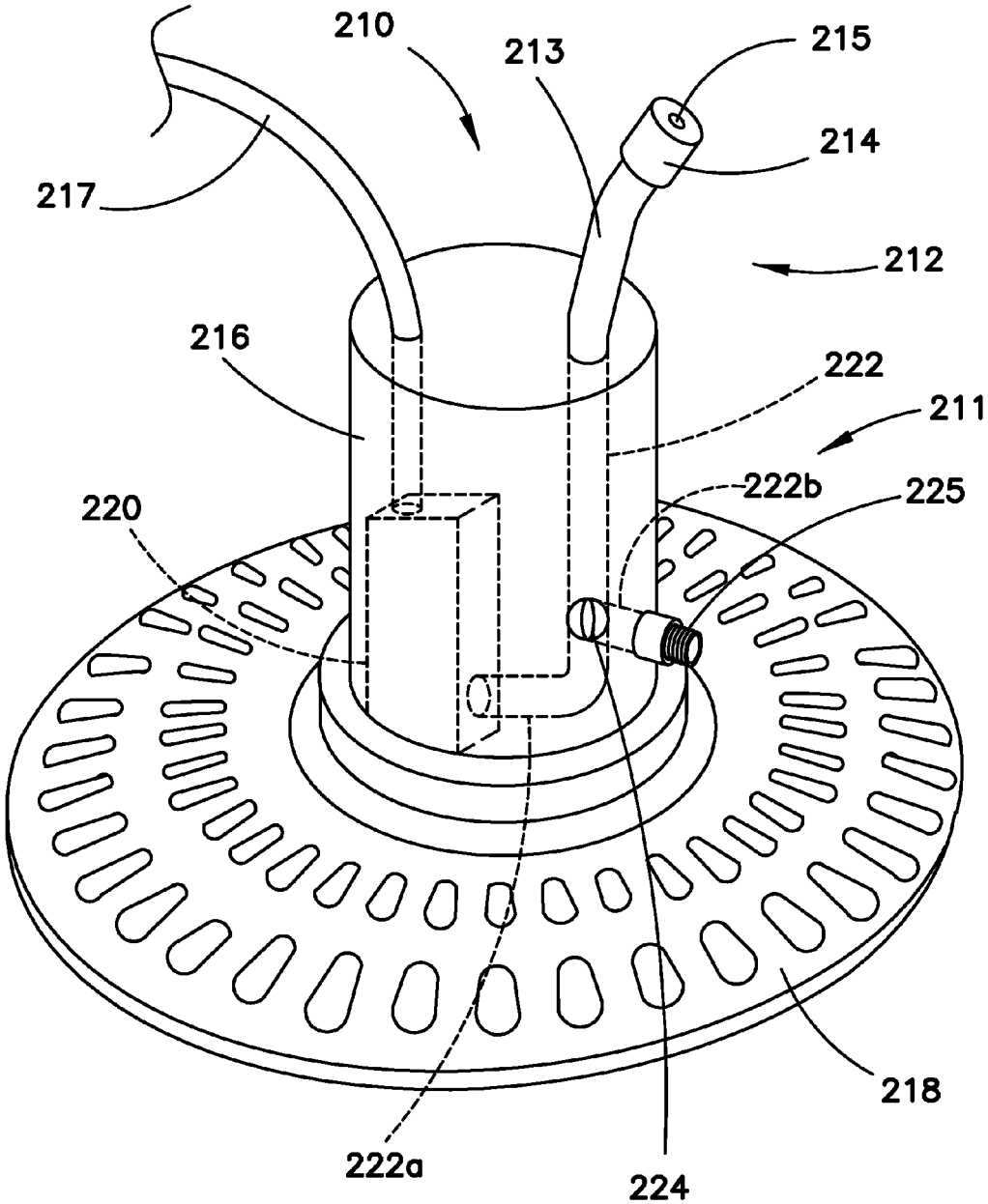
FIG. 12 is a view of another swimming pool cover pump having both an integral water ejection spout in accordance with the present principles and a threaded water outlet for connecting a garden hose, along with a user-controlled valve to select between water discharge from the water ejection spout and the garden hose water outlet.

Referring to FIG. 12, there is shown another swimming pool cover pump having an integral or "built-in" water ejection spout, generally designated 210, fashioned in accordance with the present principles. Particularly, the swimming pool cover pump with integral water ejection spout 210 includes a swimming pool cover pump 211 with an integral water ejection spout 212 and a separate water outlet 225 fashioned in typical manner to accept a garden hose (not shown).

The swimming pool cover pump 211 may be fashioned as a typical swimming pool cover pump having a housing 216 that encloses an electrically driven pump 220 having an inlet at the bottom of the housing 216. An electrical cord 217 supplies electricity to the electrical pump 220. A base 218 defining a debris screen is provided about the base of the pump housing 216.

Internal piping 222*a* extends from the electrical pump 220 to a valve or switch 224. Piping 222 extends from the valve 224 to the water ejection spout 212 which is situated at the top of the housing 216. Of course, the water ejection spout 212 may extend from a side of the housing 216 or other portion as desired. The water ejection spout 212 is characterized by a length of conduit or piping 213 having a nozzle 214 on its end. The conduit 213 of the water ejection spout 212 is in communication with the nozzle 214. The nozzle 214 has an orifice 215 that is configured to discharge water being pumped by the electrical pump 220 in the form of a spray, stream, jet or the like. The conduit 213 is preferably, but not necessarily, fixedly bent, curved or angled (configured) such that the nozzle 214 discharges the outgoing water, up, outwardly and/or away from the swimming pool cover (see, e.g., FIGS. 2 and 4).

The valve 224 is also in communication with the water outlet 225. Particularly, internal piping 222*b* extends from the valve 225 to the water outlet 225. As indicated above, the water outlet 225 is configured to receive a garden hose. As such, the water outlet 225 has external threading to receive an internally threaded hose coupling of a typical garden hose (not shown). Other connection schemes may be used. The valve 224 fluidly connects either the water ejection spout 212 or the water (hose) outlet 225 to the electrical pump 220, thus allowing the user to select whether the pool cover water 14 being pumped by the electrical pump 220 is discharged by the water ejection spout 212 or through the water (hose) outlet 225.

Figure 13:
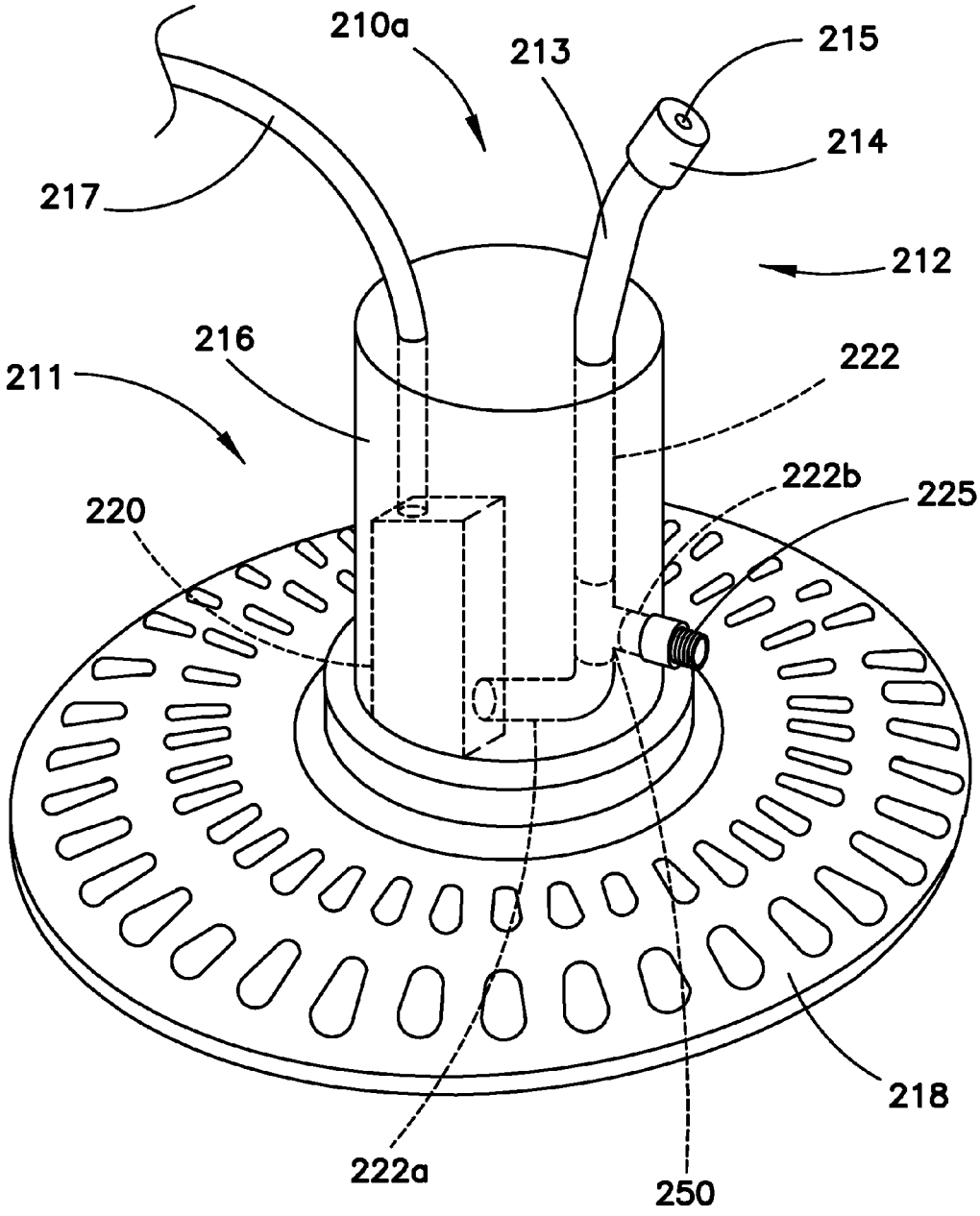
FIG. 13 is a view of another swimming pool cover pump having both an integral water ejection spout in accordance with the present principles and a threaded water outlet for connecting a garden hose.

Referring to FIG. 13, there is shown another swimming pool cover pump having an integral or "built-in" water ejection spout, generally designated 210*a*, fashioned in accordance with the present principles. Particularly, the swimming pool cover pump with integral water ejection spout 210 includes a swimming pool cover pump 211 with an integral water ejection spout 212 and a separate water outlet 225 fashioned in typical manner to accept a garden hose (not shown) in like manner to the swimming pool cover pump 210 of FIG. 12.

The swimming pool cover pump 211 may be fashioned as a typical swimming pool cover pump having a housing 216 that encloses an electrically driven pump 220 having an inlet at the bottom of the housing 216. An electrical cord 217 supplies electricity to the electrical pump 220. A base 218 defining a debris screen is provided about the base of the pump housing 216.

Internal piping 222*a* extends from the electrical pump 220 to a T component 250 that splits the outgoing water flow from the electrical pump 220 into two outgoing water flows, one from a first water outlet and one from a second water outlet. Piping 222 extends from the first outlet of the T component 250 to the water ejection spout 212 which is situated at the top of the housing 216. Of course, the water ejection spout 212 may extend from a side of the housing 216 or other portion as desired. The water ejection spout 212 is characterized by a length of conduit or piping 213 having a nozzle 214 on its end. The conduit 213 of the water ejection spout 212 is in communication with the nozzle 214. The nozzle 214 has an orifice 215 that is configured to discharge water being pumped by the electrical pump 220 in the form of a spray, stream, jet or the like. The conduit 213 is preferably, but not necessarily, fixedly bent, curved or angled (configured) such that the nozzle 214 discharges the outgoing water, up, outwardly and/or away from the swimming pool cover (see, e.g., FIGS. 2 and 4).

The second water outlet of the T component 250 is connected to piping 222*b* which coupled to the water outlet 225. As indicated above, the water outlet 225 is configured to receive a garden hose. As such, the water outlet 225 has external threading to receive an internally threaded hose coupling of a typical garden hose (not shown). Other connection schemes may be used. The T component 250 fluidly connects both the water ejection spout 212 and the water (hose) outlet 225 to the electrical pump 220. In order to select one water outlet over the other water outlet, the user caps, plugs or otherwise blocks water flow from one of the two water outlets. This allows the user to select whether the water pumped by the electrical pump 220 is discharged by the water ejection spout 212 or through the water (hose) outlet 225.

Figure 14:
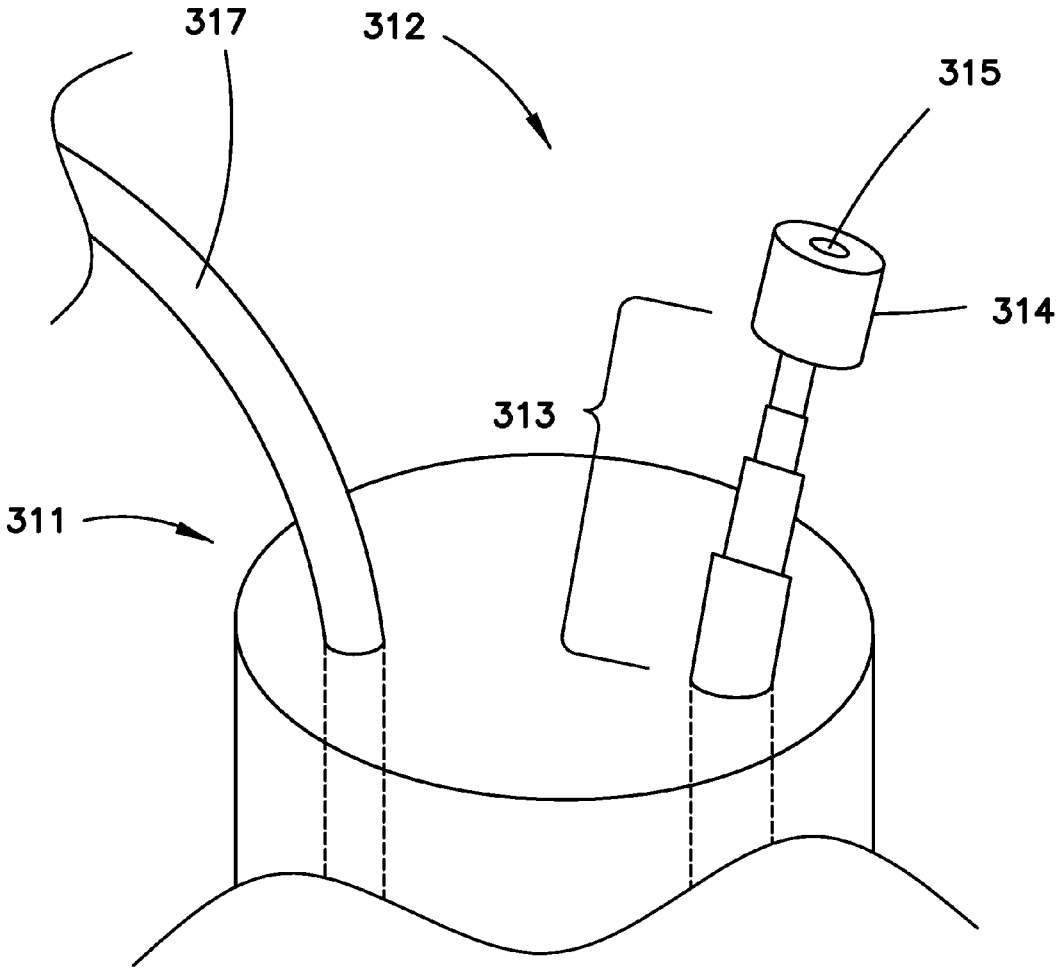
FIG. 14 is a view of a telescoping water ejection spout for the present swimming pool cover pump.

FIG. 14 shows an alternative embodiment of a water ejection spout, generally designated 313, that can be used with the present swimming pool cover pumps described herein. The water ejection spout 313 has telescoping piping 313 that extends from the swimming pool cover pump housing 311, in like manner to the previous water ejection spouts, to a nozzle 315. The telescoping piping 313 has a plurality of nesting piping sections that extend and contract such as is known in the art. The telescoping piping 313 may consist of as many nesting piping sections as desired to achieve a desired length when fully extended, thereby adjusting the orientation of the nozzle 325 and thus the directed stream of discharging water.

Figure 15:
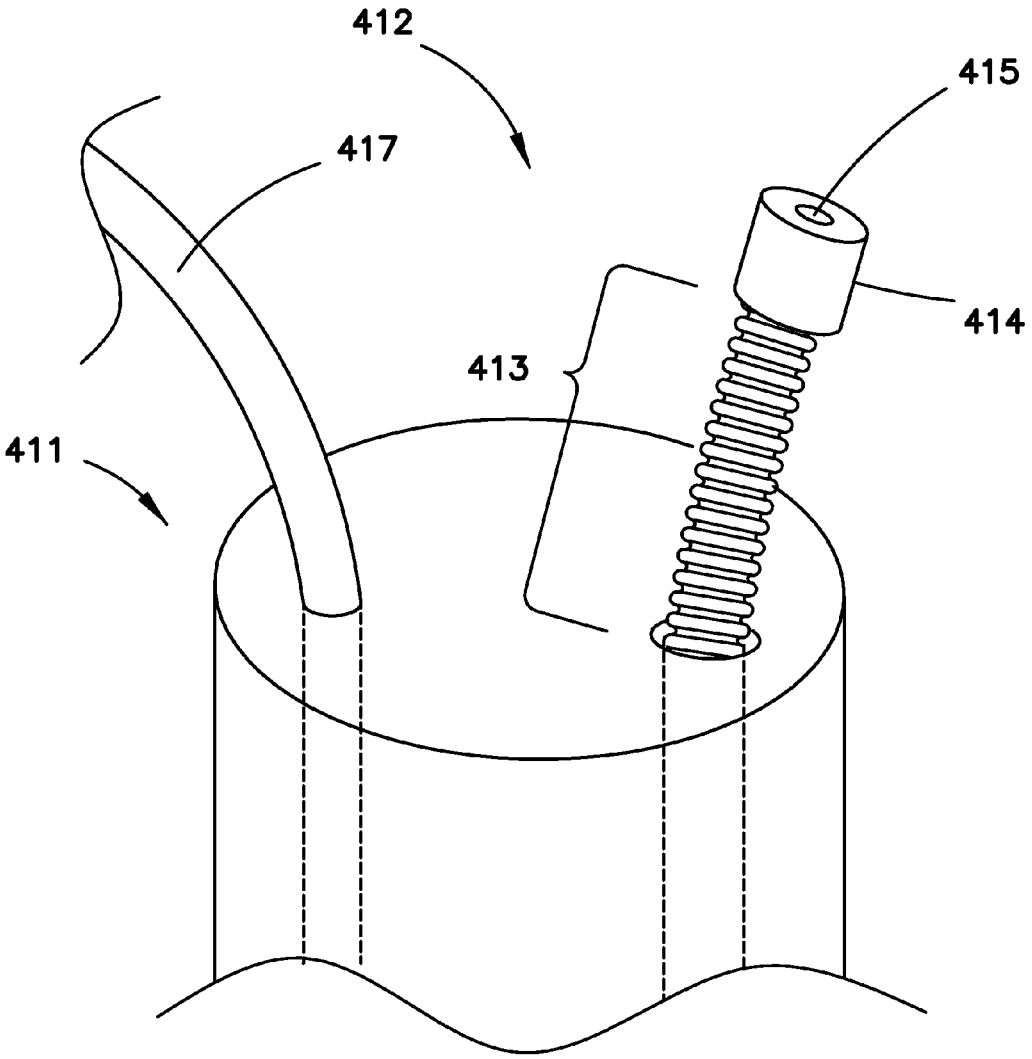
FIG. 15 is a view of a bendably positionable water ejection spout for the present swimming pool cover pumps.

FIG. 15 shows an alternative embodiment of a water ejection spout, generally designated 413, that can be used with the present swimming pool cover pumps described herein. The water ejection spout 413 has flexible and bendable piping 413 that extends from the swimming pool cover pump housing 411, in like manner to the previous water ejection spouts, to a nozzle 415. As such, the piping 413 may be curved or shaped as desired in order to adjust adjusting the orientation of the nozzle 325 and thus the directed stream of discharging water.

Figure 16:
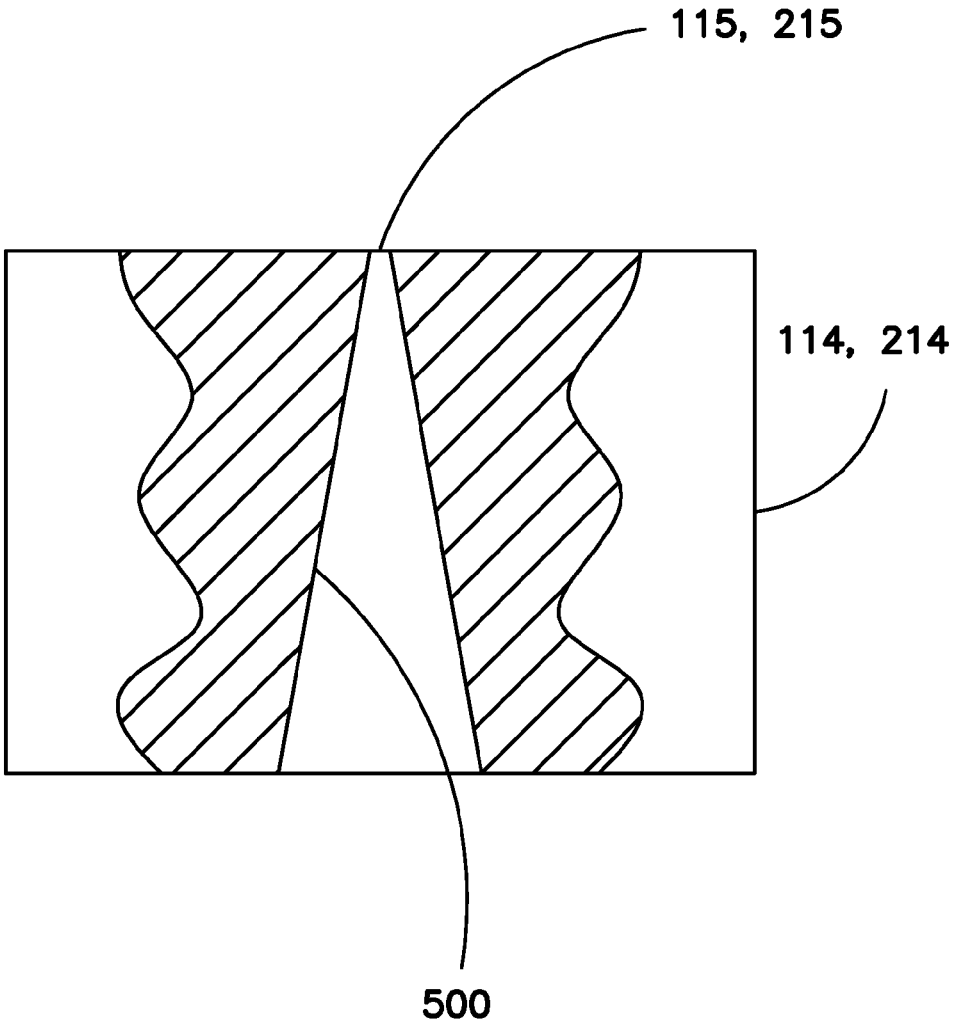
FIG. 16 is an enlarged sectional view of a nozzle for the present water ejection spouts.

FIG. 16 shows the nozzle 114, 214 wherein the nozzle has an internal configuration that increases the velocity of the outgoing stream of water in order to further project the outgoing stream of water from the swimming pool cover pump and thus the swimming pool cover. Particularly, the nozzle has internal tapering 500 before the water orifice/outlet 115, 215 to increase the water pressure as the discharging water runs through the nozzle. This allows the water to be ejected further (greater distance and pressure) than a typical nozzle. Other manners of achieving increased velocity/water pressure are contemplated. The nozzle may further have a configuration that allows adjustment of the velocity of the outgoing stream of water. It should be appreciated that these nozzle features also apply to the stand-alone water ejection spouts. As well, the features of the stand-alone water ejection spouts are applicable to the nozzles of the integral pump version. Moreover, the stand-alone spouts may have a conduit of a fixed shape that provides a fixed direction and inclination of the outgoing stream of water. In another form, the stand-alone spout may have a telescoping conduit structure that provides telescoping adjustment to the direction and inclination of the outgoing stream of water. In yet another form, the stand-alone spout may have a bendable conduit that provides infinite adjustment to the direction and inclination of the outgoing stream of water. Other conduit and spout configurations of the stand-alone spouts for adjustment of the direction and/or inclination of the outgoing stream of water are contemplated.

Those of skill in the art will understand that various details of the present invention may be changed without departing from the spirit and scope of the invention. Furthermore, the foregoing description is for illustration only, and not for the purpose of limitation, the invention being defined by the claims. Moreover, the various features of the various embodiments shown and described herein may be interchanged as desired.

While the invention has been illustrated and described in detail in the foregoing drawings and description, the same is to be considered as illustrative and not restrictive in character, it being understood that only illustrative forms thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A apparatus for removing water from a swimming pool cover, the pump apparatus comprising:

a light-weight plastic housing;

submersible AC electric motor powered water pump situated in the light-weight plastic housing, the submersible AC electric motor powered water pump operably connected to an electrical cord having an electrical plug configured for connection to a source of AC electricity, a water inlet positioned to receive water accumulated on a swimming pool cover, and a water outlet positioned to discharge the water received via the water inlet, the water outlet extending from the submersible AC electric motor powered water pump to exterior of the light-weight plastic housing and terminating in a first threaded hose coupling; and a plastic water ejection spout having a second threaded hose coupling configured to releasably connect with the first threaded hose coupling of the water outlet providing fluid communication with the water outlet, the plastic water ejection spout including a water ejection nozzle having a nozzle outlet with an outlet aperture sized to propel water upwardly and outwardly from the light-weight plastic housing.

2. The pump apparatus of claim 1, wherein the plastic water ejection spout extends above the light-weight plastic housing.

3. The pump apparatus of claim 2, wherein the plastic water ejection spout includes an S-shaped self-draining conduit having an inlet in communication with the second threaded coupling, and an outlet in communication with the water ejection nozzle.

4. The swimming pool cover pump of claim 3, wherein the conduit comprises a telescoping conduit.

5. The swimming pool cover pump of claim 3, wherein the conduit comprises a bendable conduit.

6. The pump apparatus of claim 3, wherein the water ejection nozzle is configured to greatly increase outgoing water pressure relative to incoming water pressure.

7. The swimming pool cover pump of claim 3, wherein the water ejection spout is configured to allow adjustment of the orientation of the water ejection nozzle and thus the outgoing water stream.

8. A method for removing water from a swimming pool cover comprising:

providing a pump apparatus according to claim 1;

orienting the water ejection spout to direct discharging water upwardly and away from the pool cover; and plugging in the pump apparatus to a source of AC electricity.

9. A swimming pool cover pump for removing water from a swimming pool cover, the swimming pool cover pump comprising:

a housing;

a water pump situated in the housing, the water pump having a water inlet positioned to receive water accumulated on a swimming pool cover, and a water outlet;

a water ejection spout extending above the housing and in communication with the water outlet, the water ejection spout configured to stream water upwardly and outwardly from the swimming pool cover pump, and including a conduit having an inlet in communication with the water outlet and an outlet in communication with a water ejection nozzle;

a garden hose water outlet in selective fluid communication with the water pump; and a valve having a valve inlet connected to the water outlet of the water pump, a first valve outlet connected to the water inlet of the water ejection spout, and a second valve outlet connected to the garden hose water outlet, the valve providing selective fluid communication between either the water outlet and the water ejection spout or the water outlet and the garden hose water outlet.

10. A swimming pool cover pump for removing water from a swimming pool cover, the swimming pool cover pump comprising:

a housing;

a water pump situated in the housing, the water pump having a water inlet positioned to receive water accumulated on a swimming pool cover, and a water outlet;

a valve having a valve inlet connected to the water outlet, a first valve outlet, and a second valve outlet;

a water ejection spout extending from the housing and in communication with the first valve outlet, the water ejection spout configured to stream water upwardly and outwardly from the swimming pool cover pump; and a hose connector water outlet extending from the housing and in communication with the second valve outlet;

the valve configured to selectively couple either the water ejection spout or the hose connector water outlet to the water pump water outlet.

11. The swimming pool cover pump of claim 10, wherein the water ejection spout extends from a top of the housing and the hose connector water outlet extends from a side of the housing.

12. The swimming pool cover pump of claim 11, wherein the water ejection spout includes a conduit having an inlet in communication with the first valve outlet, and an outlet in communication with a water ejection nozzle.

13. The swimming pool cover pump of claim 12, wherein the conduit comprises a telescoping conduit.

14. The swimming pool cover pump of claim 12, wherein the conduit comprises a bendable conduit.

15. The swimming pool cover pump of claim 12, wherein the nozzle is configured to increase outgoing water pressure relative to incoming water pressure.

16. The swimming pool cover pump of claim 12, wherein the water ejection spout is configured to allow adjustment of the orientation of the water ejection nozzle and thus the outgoing water stream.

* * * * *